US011918076B2

(12) United States Patent
Rodriguez et al.

(10) Patent No.: US 11,918,076 B2
(45) Date of Patent: Mar. 5, 2024

(54) METHOD FOR MANUFACTURING AN ARTICLE OF FOOTWEAR AND ARTICLES OF FOOTWEAR SO FORMED

(71) Applicant: Reebok International Limited, London (GB)

(72) Inventors: Erasmo Rodriguez, Boston, MA (US); Brian J. Christensen, Centerville, MA (US); Brian Hamilton, North Billerica, MA (US); Ricardo Vestuti, Providence, RI (US); Brenna Donnelly, Jamaica Plain, MA (US)

(73) Assignee: Reebok International Limited, Altrincham (GB)

( * ) Notice: Subject to any disclaimer, the term of this patent is extended or adjusted under 35 U.S.C. 154(b) by 68 days.

(21) Appl. No.: 16/789,652

(22) Filed: Feb. 13, 2020

(65) Prior Publication Data

US 2021/0251340 A1 Aug. 19, 2021

(51) Int. Cl.

| | |
|---|---|
| ***A43B 23/22*** | (2006.01) |
| ***A43B 23/02*** | (2006.01) |
| ***A43B 23/04*** | (2006.01) |
| ***A43D 25/047*** | (2006.01) |

(52) U.S. Cl.

CPC ..... *A43B 23/22* (2013.01); *A43B 23/025* (2013.01); *A43B 23/026* (2013.01); *A43B 23/042* (2013.01); *A43D 25/047* (2013.01)

(58) Field of Classification Search

CPC ..... A43B 23/22; A43B 23/025; A43B 23/026; A43B 23/042; A43B 23/0235; A43B 23/0255; A43B 23/0265; A43B 1/04; A43B 23/0275; A43B 23/027; A43D 25/047

See application file for complete search history.

(56) References Cited

U.S. PATENT DOCUMENTS

| | | | | |
|---|---|---|---|---|
| 2,497,528 | A * | 2/1950 | Baker | A43B 3/16 36/59 C |
| 4,578,883 | A * | 4/1986 | Dassler | A43B 5/00 36/25 R |
| D475,511 | S * | 6/2003 | Reynolds | D2/951 |
| D475,513 | S * | 6/2003 | Reynolds | D2/960 |
| 9,883,712 | B1 * | 2/2018 | Toro | A43B 13/223 |
| D812,884 | S * | 3/2018 | Raysse | D2/951 |
| 10,561,195 | B2 * | 2/2020 | Jurgeto | A43B 3/20 |
| 2004/0118018 | A1 * | 6/2004 | Dua | A43B 1/14 36/3 A |
| 2006/0048413 | A1 * | 3/2006 | Sokolowski | A43B 23/0235 36/45 |
| 2013/0059116 | A1 * | 3/2013 | Peikert | A43B 13/026 36/25 R |
| 2013/0205619 | A1 * | 8/2013 | Hartveld | A43B 13/12 36/91 |
| 2017/0035149 | A1 * | 2/2017 | Bruce | D04C 1/08 |
| 2018/0271216 | A1 * | 9/2018 | La O' | A43B 23/0265 |
| 2021/0112926 | A1 * | 4/2021 | Bessho | A43B 23/0245 |

* cited by examiner

*Primary Examiner* — Alissa L Hoey

*Assistant Examiner* — Akwokwo Olabisi Redhead

(74) *Attorney, Agent, or Firm* — Sterne, Kessler, Goldstein & Fox P.L.L.C.

(57) ABSTRACT

A method for manufacturing an article of footwear includes arranging a three-dimensional upper on a last and placing a plurality of elongated support structures on the three-dimensional upper arranged on the last using an automated placement assembly. The method further includes heating the plurality of elongated support structures to secure the plurality of elongated support structures to the upper.

9 Claims, 12 Drawing Sheets

METHOD FOR MANUFACTURING AN ARTICLE OF FOOTWEAR AND ARTICLES OF FOOTWEAR SO FORMED

FIELD

Embodiments described herein generally relate to methods of manufacturing footwear having support structures. Specifically, embodiments described herein relate to methods for manufacturing footwear and footwear components by automatically placing support structures directly on a footwear component, such as an upper, via an automated placement assembly.

BRIEF SUMMARY OF THE INVENTION

Some embodiments described herein relate to a method for manufacturing an article of footwear that includes arranging a three-dimensional upper on a last, placing a plurality of elongated support structures on the three-dimensional upper arranged on the last using an automated placement assembly, and heating the plurality of elongated support structures to secure the plurality of elongated support structures to the upper.

Some embodiments described herein relate to an article of footwear that includes a knit upper, a sole secured to the knit upper, and a plurality of elongated support structures. The article of footwear may include one or more of the elongated support structures that are arranged so as to extend from the sole onto the knit upper, and the plurality of elongated support structures may be thermally bonded to the knit upper.

Some embodiments described herein relate to a method for manufacturing an article of footwear that includes arranging an upper on a platform, wherein the upper includes a bottom and is configured to enclose a wearer's foot, placing a plurality of elongated support structures on at least the bottom of the upper arranged on the platform using an automated placement assembly, heating the plurality of elongated support structures to secure the plurality of elongated support structures to the bottom of the upper, and securing a sole to the bottom of the upper.

In any of the various embodiments discussed herein, the plurality of elongated support structures may include reinforcement tape.

In any of the various embodiments discussed herein, the plurality of elongated support structures include fibers.

In any of the various embodiments discussed herein, a method of manufacturing an article of footwear may include placing a plurality of second elongated support structures on the upper using the automated placement assembly such that the plurality of second elongated support structures at least partially overlaps the plurality of elongated support structures. In some embodiments, the plurality of elongated support structures and the plurality of second elongated support structures may form a lattice. In some embodiments, one or more of the plurality of second elongated support structures may be arranged at an angle of 5 to 85 degrees relative to one or more of the plurality of elongated support structures.

In any of the various embodiments discussed herein, a method of manufacturing an article of footwear may further include forming eyelets using the plurality of elongated support structures.

In any of the various embodiments discussed herein, a method of manufacturing an article of footwear may further include movably positioning the last relative to the automated placement assembly.

In any of the various embodiments discussed herein, a method of manufacturing an article of footwear may further include securing a sole to the upper, wherein placing the plurality of elongated support structures may include arranging one or more of the plurality of elongated support structures so as to extend from the sole onto the upper.

In any of the various embodiments discussed herein, the plurality of elongated support structures may be secured to the knit upper without stitches.

In any of the various embodiments discussed herein, the knit upper may be a sock-type knit upper.

In any of the various embodiments discussed herein, the plurality of elongated support structures may be arranged parallel to one another.

In any of the various embodiments discussed herein, an article of footwear may further include a plurality of second elongated support structures arranged at an angle relative to the plurality of elongated support structures, wherein the angle may be 5 to 85 degrees.

In any of the various embodiments discussed herein, the upper may be a sock-type knit upper.

In any of the various embodiments discussed herein, the plurality of elongated support structures may include at least one of fibers and reinforcement tape.

In any of the various embodiments discussed herein, wherein the upper includes a toe region, a midfoot region, and a heel region, and wherein placing the plurality of elongated support structures may include placing the plurality of elongated supported structures on the midfoot region.

In any of the various embodiments discussed herein, a method of manufacturing an article of footwear may further include forming eyelets using one or more of the plurality of elongated support structures.

In any of the various embodiments discussed herein, the plurality of elongated support structures may be automatically placed on the upper in accordance with a predetermined pattern.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

FIG. 1 shows a schematic view of an automated placement assembly and a footwear component arranged on a last according to an embodiment.

FIG. 2A shows a plan view of an end portion of a reinforcement tape according to an embodiment. FIG. 2B shows a plan view of an end portion of a reinforcement tape according to an embodiment. FIG. 2C shows a plan view of an end portion of a reinforcement tape according to an embodiment.

DETAILED DESCRIPTION OF THE INVENTION

Figure 1:
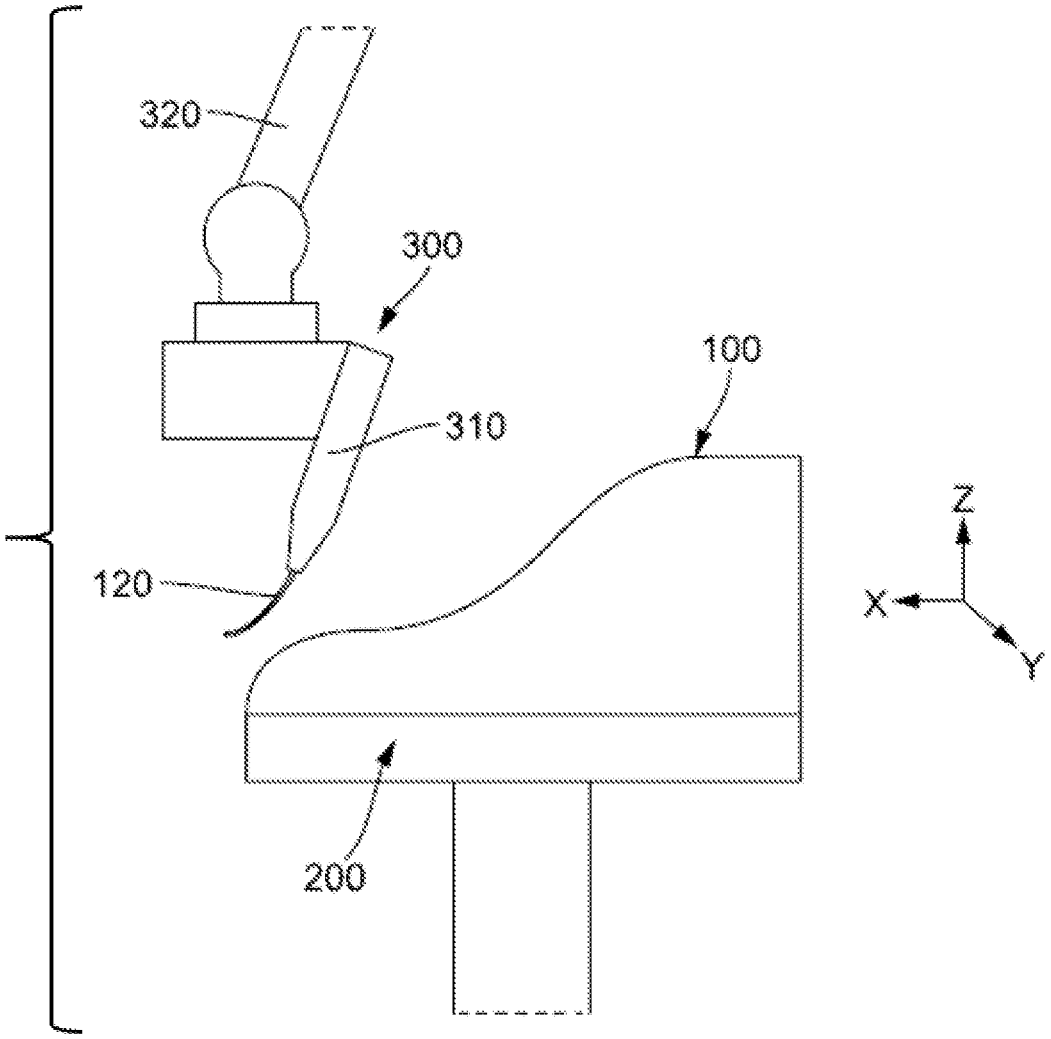

Reference will now be made in detail to representative embodiments illustrated in the accompanying drawing. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

It is often desirable to position support structures on footwear components, such as an upper for an article of footwear, in order to customize the properties of the footwear. Support structures may be secured to an upper of an article of footwear in order to provide additional support or stability to certain areas of the footwear, while maintaining flexibility and breathability in other areas of the footwear. For example, it may be desirable to provide additional support and stability at a heel or ankle region of an article of footwear, while allowing for flexibility and breathability in a toe region of the footwear.

In order to form footwear including such support structures, separate processes are generally used to form the upper and the support structures. Support structures may be formed by die cutting a material, such as a woven sheet, into a desired shape. The die-cut woven sheet can then be placed into a specially-made mold to provide the woven sheet with the desired geometry for supporting different regions of the upper. One or more finishing processes may be performed on the molded support structure, and the finished molded support structure can then be joined to the upper.

Forming the support structure in a separate process and using a specially-made mold may add to the expense of producing the footwear. If a different design for the support structure is desired, considerable retooling is required to prepare new or additional dies and molds to create a support structure with the desired shape or configuration. Further, the molding process can be time-consuming and labor intensive. Additional processing steps required to finish the molded support structure prior to attaching the same to the upper may further add to the time and expense of producing the article of footwear.

In addition to the limitations of the molded support structure, the use of the woven sheets for forming support structures generally allows for fibers to be oriented at angles of either 0 or 90 degrees. As a result, the ability to customize the placement and arrangement of support structures on the upper may be limited.

Some embodiments described herein relate to a method for manufacturing an article of footwear or a footwear component in which elongated support structures are applied directly to the footwear component. In this way, footwear components having support structures can be made in a single process without the use of molds or other tooling to form the support structures. Some embodiments described herein relate to a method for manufacturing an article of footwear or a footwear component in which elongated support structures are applied via an automated placement assembly so that the elongated support structures can be applied to the footwear in any of various directions and orientations, allowing for unique and complex arrangements of support structures on the upper to be achieved.

Some embodiments described herein relate to a method of forming an article of footwear or a footwear component that includes placing elongated support structures 120 on a footwear component 100 via an automated placement assembly 300, as shown for example in FIG. 1. Automated placement assembly 300 may include a dispensing head 310 configured to hold and dispense elongated support structures 120 directly onto a footwear component 100, such as an upper.

Dispensing head 310 may be configured to hold and dispense elongated support structures 120, such as one or more pieces of tape, one or more fibers, or both. In some embodiments, automated placement assembly 300 may hold a roll or a spool of tape or fibers. In some embodiments, automated placement assembly 300 may include a cutting tool configured to cut the support structures 120 in order to separate a portion of a support structure 120, e.g., a fiber or tape, from the dispensing head 310. However, in some embodiments, an operator may manually cut the tape or fiber from the spool prior to placement of an additional support structure from the dispensing head 310.

Dispensing head 310 of automated placement assembly 300 may be mounted on an articulating arm 320 configured to move dispensing head 310 along one or more axes. In some embodiments, articulating arm 320 may be configured to move dispensing head 310 along three or more axes. For example, articulating arm 320 may be configured to move dispensing head 310 along an X-axis that extends in a direction from a heel to a toe of the footwear component (e.g., forward and backward movement), a Y-axis that extends in a direction from a lateral side to a medial side of footwear component (e.g., left and right movement), and a Z-axis that extends in a direction from a bottom of the footwear component to a top of the footwear component (e.g., up and down movement). In some embodiments, articulating arm 320 may allow for additional degrees of movement of dispensing head 310. For example, dispensing head 310 may be configured to tilt or rotate about one or more of the X-, Y- and Z-axes.

In this way, automated placement assembly 300 is configured to place each support structure 120 in any of various directions or orientations on a footwear component 100. For example, support structures 120 may be placed so as to extend from a medial side to a lateral side of footwear component, support structures 120 may be placed so as to extend around a heel region of footwear component 100, or support structure 120 may extend along a lateral or medial side of footwear component 100 in a direction from a toe region to a heel region, among various other arrangements. In some embodiments, support structures 120 may be positioned so as to extend from a bottom portion or sole of the footwear component 100 onto an upper of the footwear component 100, as discussed in further detail below.

Automated placement assembly 300 may create various patterns or arrangements of support structures 120 on the footwear component 100 in order to provide support to specific regions of the footwear, and/or to provide a desired aesthetic appearance or visual effect. As each elongated support structure 120 may be placed in a specific direction and orientation on footwear component 100, support structures 120 may be arranged in unique and complex patterns. Such patterns may not be achievable using conventional molding methods for forming support structures for articles of footwear, or may achieved only with considerable time, labor and expense.

In some embodiments, a footwear component 100, such as a three-dimensional upper, may be arranged on a last 200, as shown in FIG. 1. Last 200 may provide footwear component 100 with the desired three-dimensional shape for forming an article of footwear. In some embodiments, last 200 may be arranged in a fixed position, such that automated placement assembly 300 moves with respect to last 200 in order to place support structures 120 on footwear component 100 arranged on last 200. However, in some embodiments, last 200 may also be movable so that last 200 may be placed in a desired orientation with respect to dispensing head 310. For example, last 200 may be configured to rotate about a Z axis in order to facilitate placement of elongated support structures 120 onto footwear component 100 by automated placement assembly 300. In some embodiments, last 200 may be configured to move along Z-axis so as to bring footwear component 100 in a desired position relative to automated placement assembly 300.

In some embodiments, automated placement assembly 300 may be controlled by a control unit. The control unit may include a memory and a processor. In some embodiments, control unit may be a computer. In such embodiments, automated placement assembly 300 may place elongated support structures 120 on footwear component 100 based on a predetermined protocol executed by the control unit. The protocol may determine the number of support structures, the type of support structures, the length of the support structures, the direction and orientation of the support structures, and the order in which the support structures are placed on the footwear component, among other aspects of the support structure placement. In some embodiments, protocol may be selected by an operator of the automated placement assembly 300, and the parameters of the protocol may be adjusted or varied by the operator. In some embodiments, automated placement assembly 300 may be controlled based on input provided by an operator, allowing the operator to dictate the placement of the support structures on the footwear component. In this way, the automated placement assembly 300 can be used to create various patterns and arrangements of support structures 120 on an upper without the need for different tools, such as cutting dies or molds.

In some embodiments, footwear component 100 may be or may include an upper for an article of footwear. The upper may be a knit upper that is formed by flat knitting using a flat knitting machine. In some embodiments, the upper may be a knit upper that is formed by circular knitting using a circular knitting machine. However, in some embodiments, the upper may be a woven upper, or a non-woven upper, among other types of uppers. The upper may be a sock-type upper configured to enclose a wearer's foot. In some embodiments, footwear component 100 may include an upper and further a sole, a midsole, or a portion thereof. The sole or midsole may be integrally formed with upper, or may be attached to the upper.

In some embodiments, elongated support structures 120 placed by automated placement assembly 300 may be, for example, a tape. Tape may include a thermoplastic or thermoplastic-composite material, such as polyamide, polyurethane, polypropylene, or a combination thereof. Tape may be a reinforcement tape, such as a glass reinforcement tape, VECTRAN®, or a seam reinforcement tape, such as those manufactured by BEMIS®. In some embodiments, elongated support structures 120 may include fibers, such as carbon fibers, glass fibers, thermoplastic fibers, or a hybrid fiber. Tape may include an adhesive on at least one surface in order to help the tape to remain in position on the footwear component after it is placed by automated placement assembly 300. The adhesive may be a pressure-sensitive adhesive. The adhesive may provide temporary securement of the tape to the upper, and the tape may be permanently secured to the footwear component via application of heat, as discussed in further detail herein.

Figures 2A, 2B, 2C:
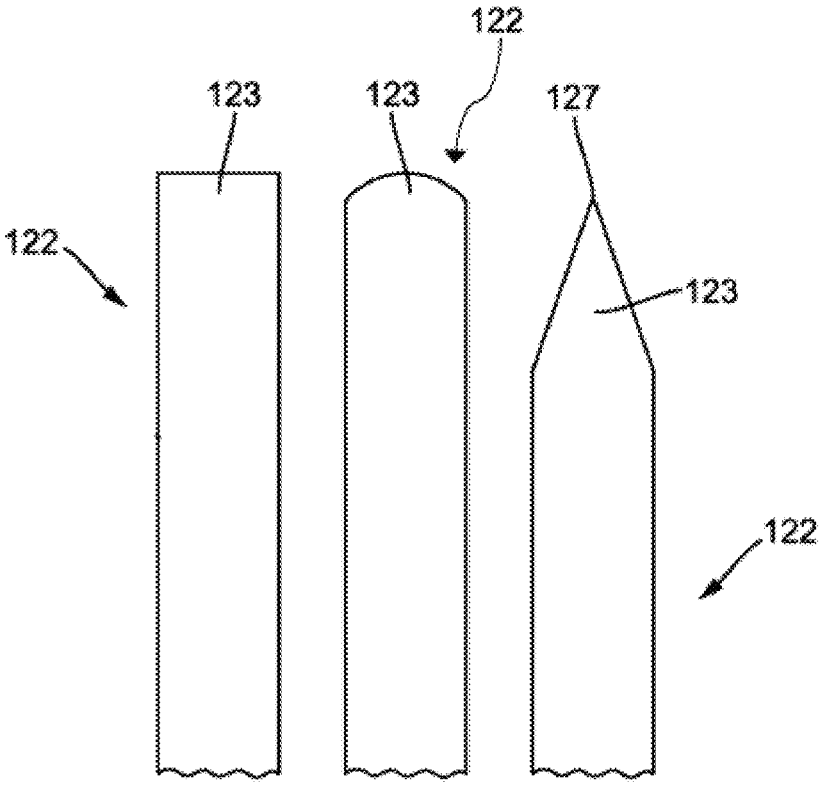

In embodiments in which support structure 120 is a tape 122, each piece or section of tape 122 may have an end portion 123, as shown for example in FIGS. 2A, 2B, and 2C. End portion 123 may have a squared shape, such that tape 122 is generally rectangular (see, e.g., FIG. 2A). However, in some embodiments, end portion 123 may have alternate shapes or arrangements. For example, end portion 123 may be tapered, and may taper towards a point 127 so as to have a triangular configuration (see, e.g., FIG. 2C). In some embodiments, end portion 123 may be rounded (see, e.g., FIG. 2B). For example, end portion 123 may be shaped so as to match a shape or contour of a perimeter edge of the footwear. In some embodiments, end portion 123 may be shaped so as to match an end portion 123 of another piece of tape 122, so that the pieces of tape 122 can be positioned in an overlapping manner while providing a uniform and continuous appearance.

Once support structures 120 are placed on the footwear component 100 by the automated placement assembly, support structures 120 may be bonded or secured to the footwear component. Support structures 120 may be secured or bonded to a footwear component 100 by application of heat. Heat may be applied via any of various methods known in the art. For example, hot air may be applied to the support structures and the footwear component to partially melt the support structures. In some embodiments, a laser system may be used to heat the support structures to bond the support structures to the upper. The laser system may provide rapid processing and may be used with a wide variety of materials. Securing support structures 120 to footwear component 100 by the application of heat allows support structures 120 to be secured to footwear component 100 without the use of stitches. Accordingly, the resulting footwear or footwear component may be stitchless.

Figure 3:
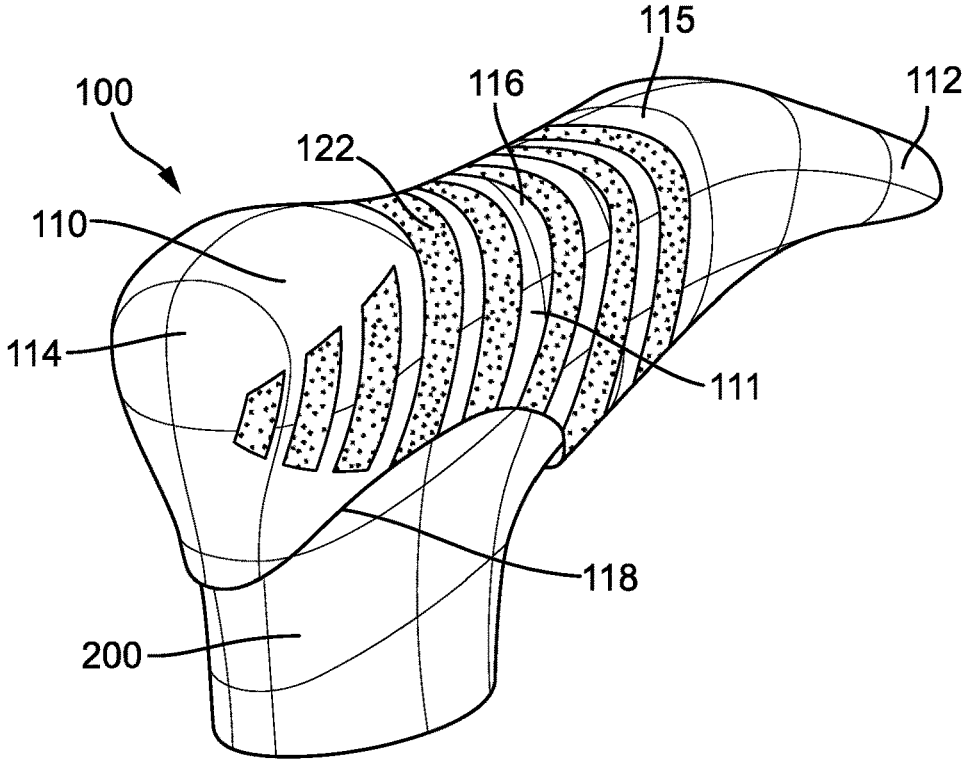
FIG. 3 shows a perspective view of a footwear component having elongated support structures arranged thereon according to an embodiment.
Figure 4:
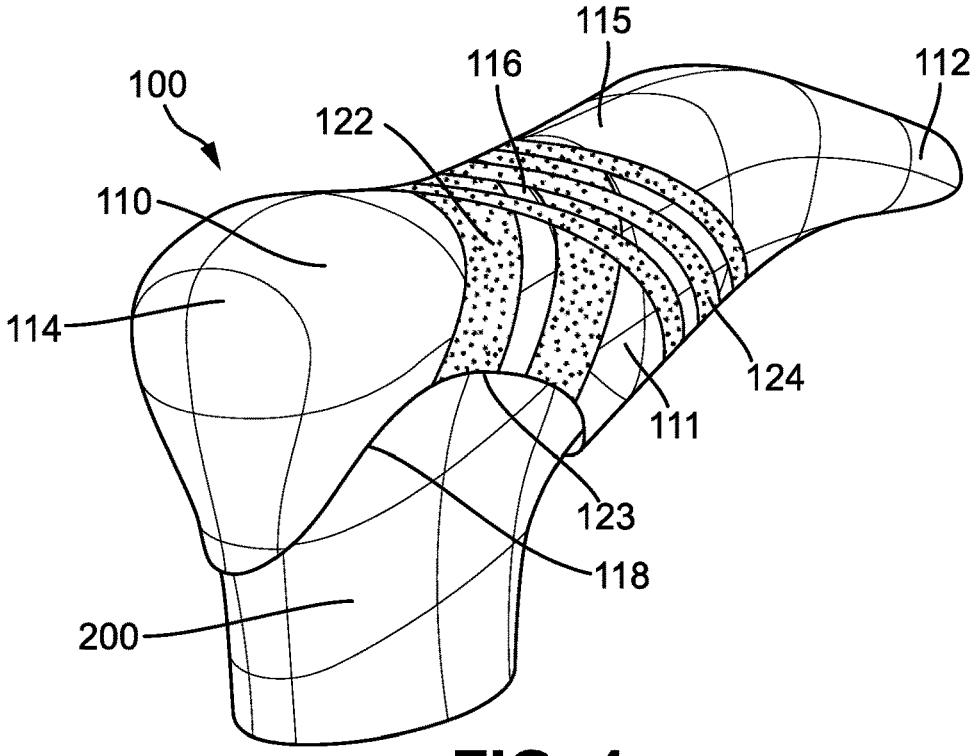
FIG. 4 shows a perspective view of a footwear component having elongated support structures arranged thereon according to an embodiment.
Figure 5:
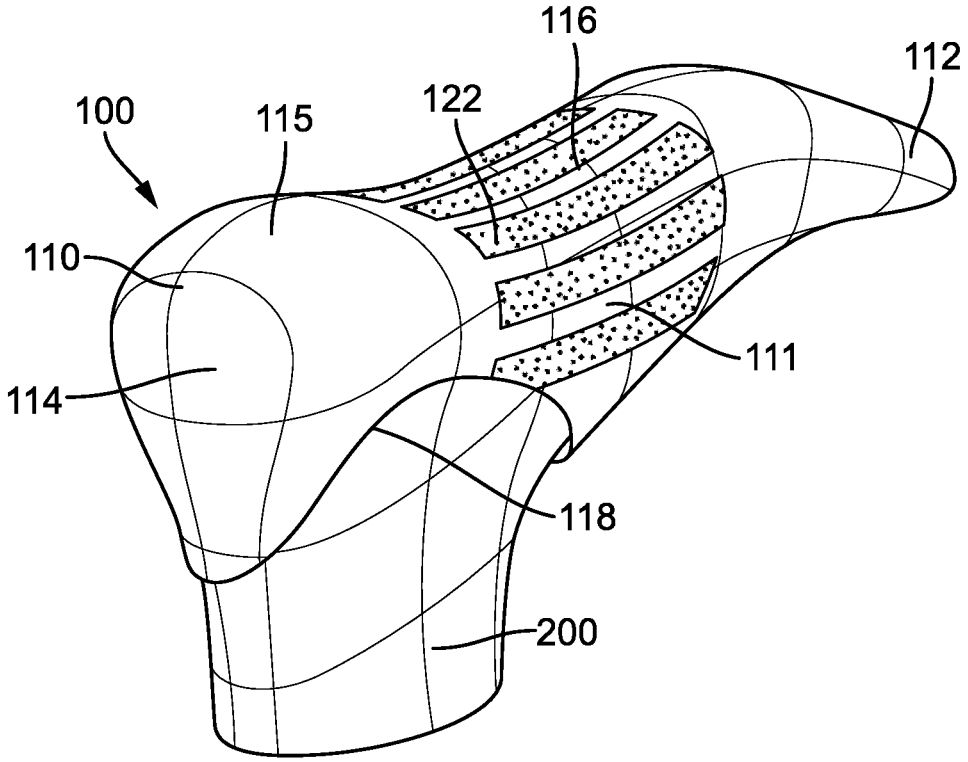
FIG. 5 shows a perspective view of a footwear component having elongated support structures arranged thereon according to an embodiment.

Support structures 120 may be arranged on a footwear component, such as an upper 110 via automated placement assembly in various patterns and orientations, as shown for example in FIGS. 3-5. As shown in FIG. 3, footwear component 100 includes an upper 110 configured to enclose a foot of a wearer, and upper 110 is arranged on a last 200. Upper 110 includes a toe region 112 opposite a heel region 114, and a midfoot region 116 therebetween. Upper 110 further includes an ankle opening 118 for receiving a foot of a wearer into upper 110 and an opposing bottom portion 115. Further, upper 110 includes a medial side 111 opposite a lateral side. In some embodiments, upper 110 may be a knit upper, a woven upper, or a non-woven upper, among other types of uppers. In some embodiments, upper 110 may be a sock-type knit upper. Upper 110 may be formed by circular knitting or by flat knitting, and may be formed using a flat knitting machine or a circular knitting machine.

As shown in FIG. 3, a plurality of support structures 122 may be placed on an upper 110 that are arranged parallel to and spaced from one another. Support structures 122 may extend from a medial side 111 to an opposing lateral side of upper 110 and may wrap around a bottom portion 115 of upper 110. One or more support structures 122 may terminate at ankle opening 118. Support structures 122 may differ in length or may have the same length. For example, support structures 122 may decrease in length from midfoot region 116 toward heel region 114. Support structures 122 arranged adjacent heel region 114 may not extend onto bottom portion 115 of upper 110 and are arranged only on a medial side 111 or lateral side of upper 110. Further, toe region 112 may not include any support structures 122, such that support structures 122 are positioned primarily on midfoot region 116 of upper 110.

In some embodiments, a plurality of first support structures 122 may be arranged in a first direction, and a second plurality of support structures 124 may be arranged in a second direction that differs from the first direction, as shown in FIG. 4. The plurality of second elongated support structures 124 may at least partially overlap the first elongated support structures 122. First elongated support structures 122 may be arranged parallel to and spaced from one another, and similarly second elongated support structures 124 may be arranged parallel and spaced from one another. The first and second elongated support structures 122, 124 may be arranged at an angle relative to one another, so as to form a lattice or grid pattern. Support structures 122, 124 may be arranged at a midfoot region 116 of upper 110, such that support structures 122, 124 are not arranged at a heel region 114 or a toe region 112 of upper 110. In this way, support structures 122, 124 may form a shank at midfoot region 116 on bottom portion 115 of upper 110 so as to provide arch support to a wearer. However, in some embodiments, support structures 122, 124 may be arranged only at heel region 114, only at midfoot region 116, only at toe region 112, or in a combination of two or more of the heel region 114, midfoot region 116, and toe region 112. One or more of elongated support structures 122, 124 may have end portions 123 that terminate at an ankle opening 118 of upper 110.

In some embodiments, support structures 122 may be arranged on midfoot region 116 extending in a direction from heel region 114 to toe region 112, as shown for example in FIG. 5. Elongated support structures 122 may be arranged parallel to and spaced from one another. Elongated support structures 122 may be positioned on midfoot region 116 on medial side 111, bottom portion 115, and a lateral side opposite medial side 111. Thus, elongated support structures 122 may not be arranged on toe region 112 or heel region 114. Each elongated support structure 122 may have the same length or approximately the same length.

Figure 8:
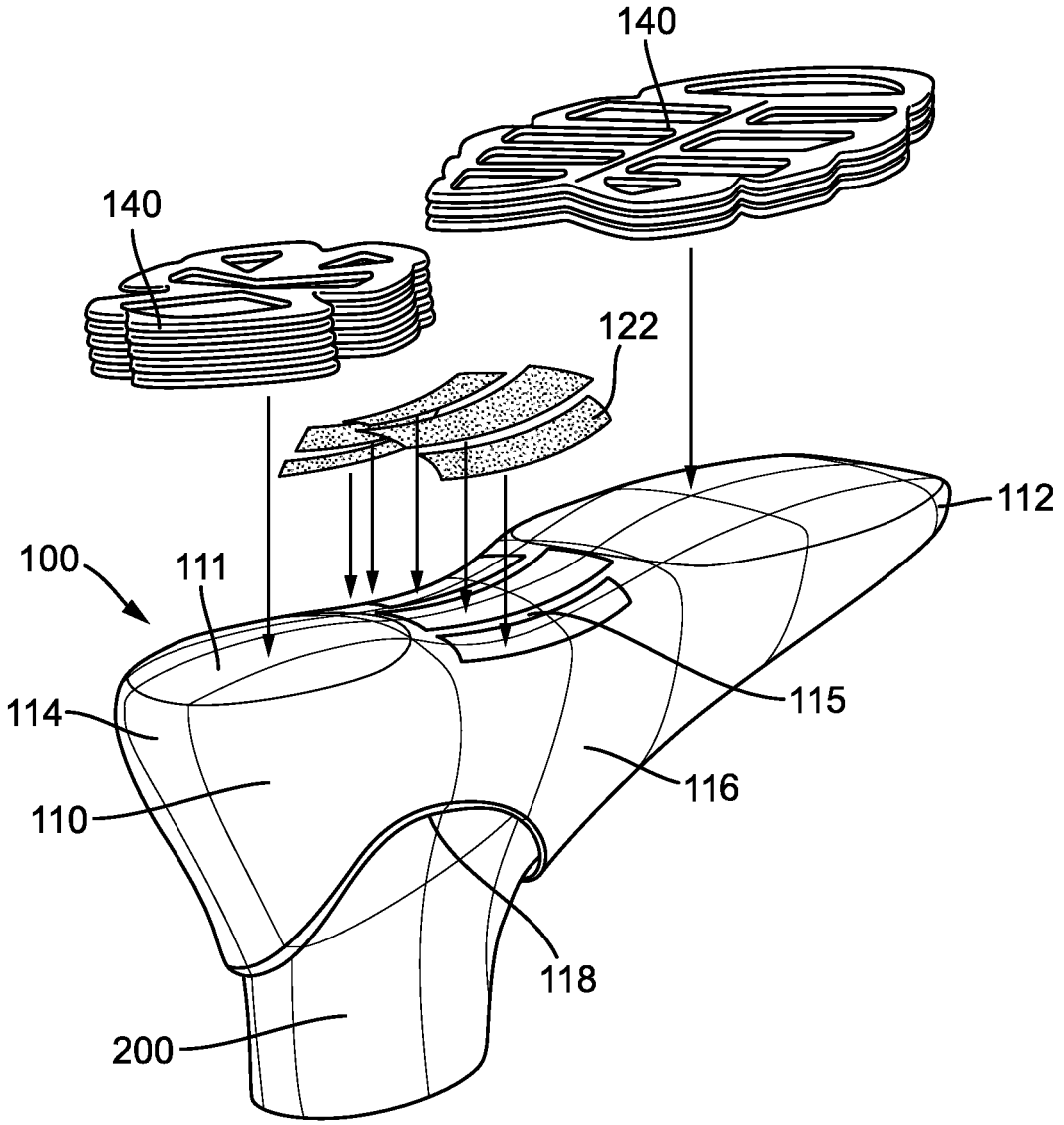
FIG. 8 shows a perspective view of a footwear component and support structures positioned for placement according to an embodiment.

In any of the embodiments shown in FIGS. 3-5, footwear component 100 may include a sole or sole element as described further herein secured to a bottom portion 115 of upper 110 (see, e.g., FIG. 8). Sole or sole elements may at least partially overlap with support structures 122, 124 placed on bottom portion 115 of upper 110. Sole elements may be secured to upper 110 with upper 110 arranged on last 200, or sole elements may be added after upper 110 is removed from last 200.

Figure 6:
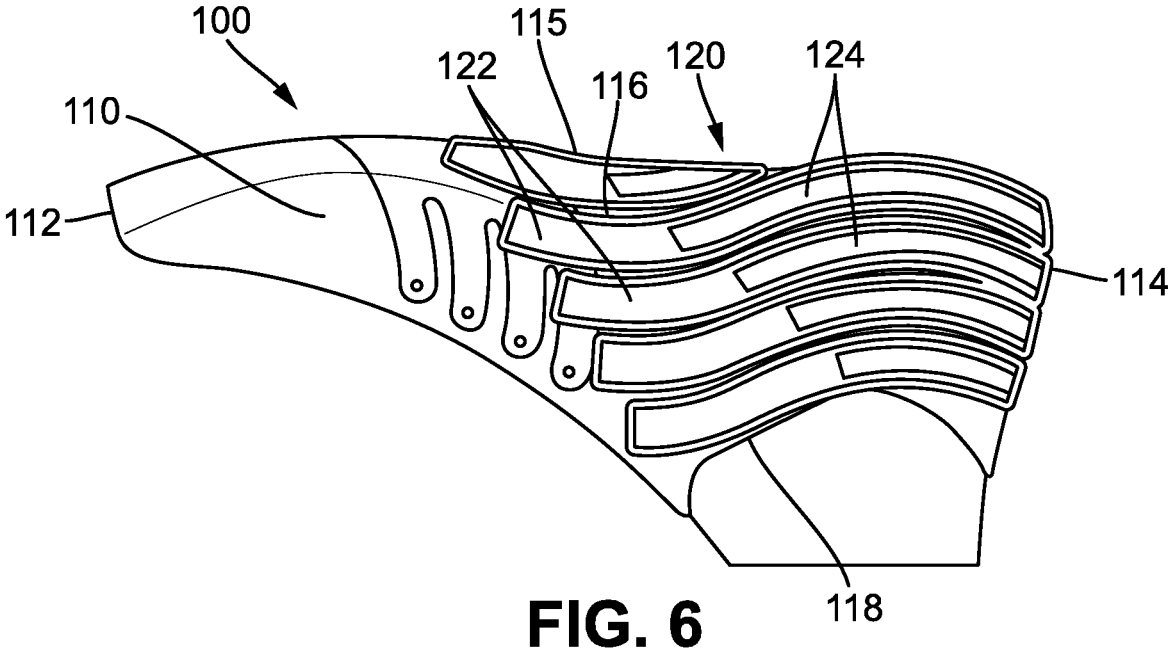
FIG. 6 shows a side view of a footwear component having elongated support structures arranged thereon according to an embodiment.

In some embodiments, elongated support structures 120 may be non-linear and may have a curved or wave-like shape, as shown for example in FIG. 6. Elongated support structures 120 may include tape 122 that extends from a midfoot region 116 to or toward heel region 114 of footwear component 100. In some embodiments, elongated support structures 120 may be arranged as a series of waves as shown in FIG. 6. Elongated support structures 120 may extend from a midfoot region 116 of footwear component around heel region 114 from a medial side of footwear component 100 to an opposing lateral side. Elongated support structures 122 may be arranged so as to follow a contour of upper 110. A plurality of second elongated support structures 124 may be positioned so as to at least partially overlap first elongated support structures 122. The plurality of second elongated support structures 124 may be positioned similarly to first elongated support structures 122 and have a shorter length than first elongated support structures 122. Thus, second elongated support structures 124 do not extend as far toward toe region 112 on midfoot region 116 and terminate closer to heel region 114. Second elongated support structures 124 can wrap around a heel region 114 of upper 110 so as to provide additional strength and rigidity to a heel region 114 of upper 110.

Figure 7:
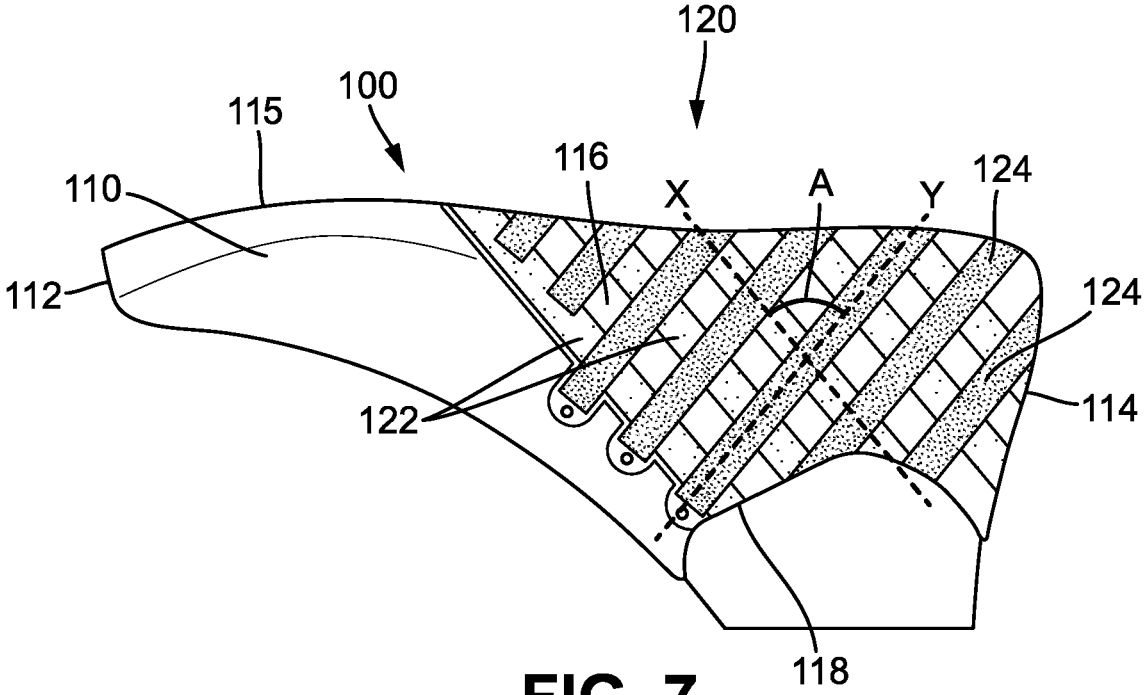
FIG. 7 shows a side view of a footwear component having elongated support structures arranged thereon according to an embodiment.

In some embodiments, elongated support structures 122, 124 may be arranged in a lattice pattern, as shown for example in FIG. 7. A plurality of first elongated support structures 122 may be arranged along or parallel to a first axis X, and a plurality of second elongated support structures 124 may be arranged along or parallel to a second axis Y. The X- and Y-axes may be arranged at an angle A to one another, such that at least a first elongated support structure 122 is arranged at an angle A relative to one or more second support structures 124. As elongated support structures 122, 124 are placed via an automated placement assembly 300 (see, e.g., FIG. 1), support structures 122, 124 can be placed on upper 110 in any of various angles with respect to one another, such that angle A may be from 0 to 180 degrees. In some embodiments, angle A may be 5 to 85 degrees, or 10 to 70 degrees. Thus, support structures 120 can be precisely positioned by automated placement assembly to create a pattern of support structures arranged at a variety of angles relative to one another.

In such embodiments, first and second elongated support structures 122, 124 may be arranged on footwear component 100 on midfoot and heel regions 114, 116. Further, support structures 122, 124 may extend from a bottom portion 115 to ankle opening 118 of upper 110. In this way, elongated support structures 122, 124 may provide stability and rigidity to heel region 114 and ankle opening 118 of footwear component 100 while allowing for flexibility in a toe region 112.

In some embodiments, as shown in FIG. 8, support structures 120 and/or sole elements 140 may be placed directly onto upper 110 while upper 110 is arranged on a last 200. In this way, a footwear component 100 may be formed in a single process (e.g., without separately forming support structures 120. A plurality of support structures, such as reinforcement tape 122 may be positioned on a midfoot region 116 of upper 110 on a bottom portion 115 of upper 110 so as to form a shank that supports an arch of the wearer's foot. Thus, support structures 122 may provide support and rigidity to midfoot region 116 of upper 110 to provide arch support. In some embodiments, support structures 120 may be arranged parallel to one another and may extend in a direction from toe region 112 toward heel region 114. However, in some embodiments, support structures 120 may be arranged in different patterns, and may have, for example, a lattice pattern (see, e.g., FIG. 4). Elongated support structures 122 may be, for example, a reinforcement tape, such as a carbon reinforcement tape. In this way, support structures 122 may provide arch support to a midfoot region 116 of footwear component 100. Further, a sole, which may include one or more sole elements 140 may be secured to upper 110. Sole or sole elements 140 may be secured to bottom portion 115 of upper 110 so as to at least partially overlap support structures 122 placed on bottom portion 115. In some embodiments, sole elements 140 may be placed at a heel region 114 and a toe region 112 of footwear component 100 on a bottom portion 115 of upper 110. In some embodiments, sole elements 140 are arranged in a stacked configuration and are secured to upper 110. In some embodiments, a plurality of elongated support structures 122 may be applied to a bottom portion 115 of upper 110 so as to form at least a portion of a sole or a midsole.

Figure 9:
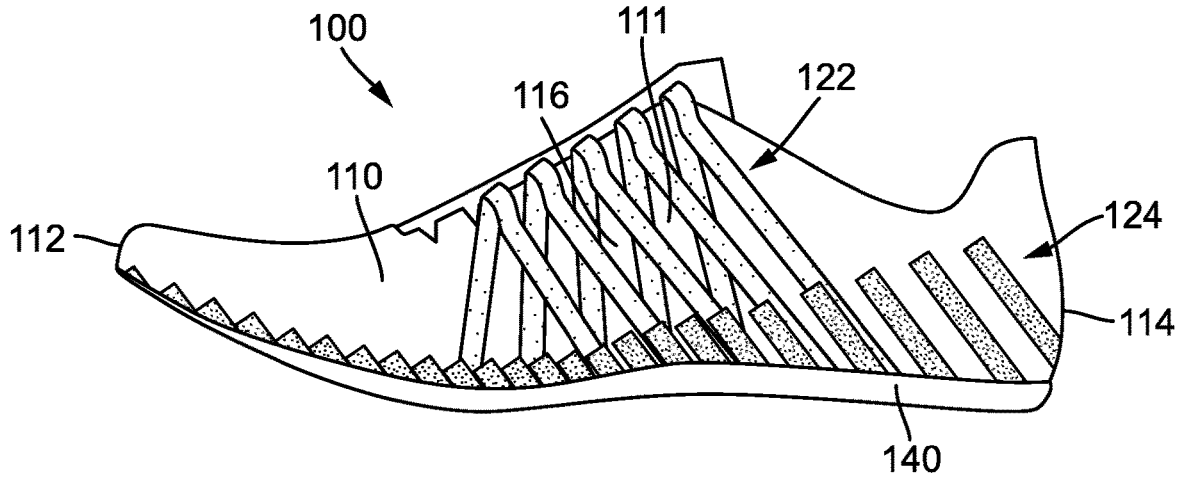
FIG. 9 shows a side view of an article of footwear having elongated support structures according to an embodiment.
Figure 10:
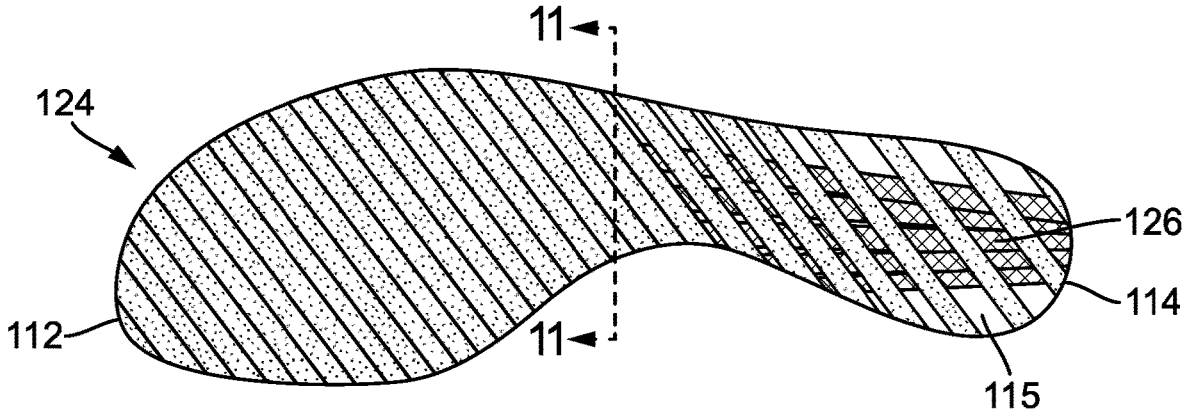
FIG. 10 shows a bottom view of the article of footwear of FIG. 9.

In some embodiments, a footwear component 100 may include an upper 110 and a sole 140, as shown for example in FIGS. 9 and 10. A plurality of first elongated support structures 122 may be arranged on a medial side 111 of upper 110 at a midfoot region 116. First elongated support structures 122 may be arranged in a first pattern. A plurality of second elongated support structures 124 may be arranged on bottom portion 115 of upper 110 extending from medial side 111 to or toward lateral side, and second elongated support structures 124 may extend from bottom portion 115 onto upper 110. Second elongated support structures 124 may at least partially overlap first elongated support structures 122. Second elongated support structures 124 may be arranged in a second pattern that differs from the first pattern of the first elongated support structures 122. Further, a plurality of third support structures 126 may be arranged on bottom portion 115 of upper 110 and extend in a direction from heel region 114 to or toward toe region 112, as best shown in FIG. 10. Third support structures 126 may be arranged in a third pattern that differs from the first or second patterns. Second support structures 124 may at least partially overlap third support structures 126. However, it is understood that support structures 122, 124, 126 may be placed on upper 110 so as to overlap in any order. Support structures 122, 124, 126 may be made of the same material, or may be made of different materials.

Figure 11:
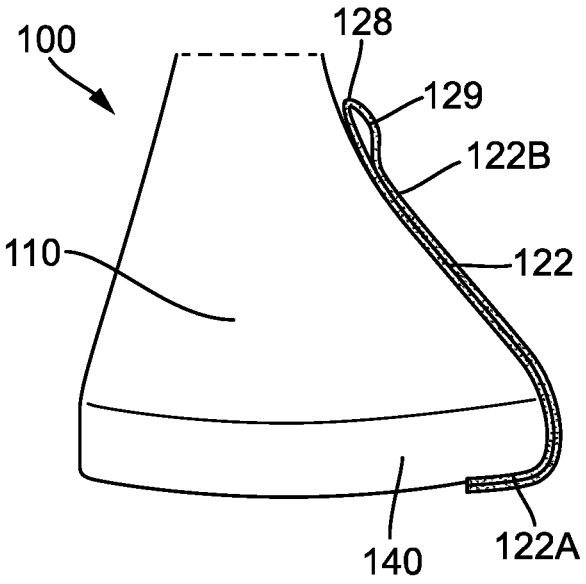
FIG. 11 shows a transverse cross sectional view of the article of footwear of FIG. 9 as taken along lines 11-11 in FIG. 10.

In some embodiments, support structures 122 may form an eyelet 129 through which a shoelace may be threaded, as shown in FIG. 11. In such embodiments, a first portion 122A of a support structure 122, such as a tape, may extend from sole 140 onto upper 110 toward an upper end of upper 110. At upper end of upper 110, support structure 122 may fold 128 and a second portion 122B may overlap with a first portion 122A of tape. First portion 122A and second portion 122B of tape may be joined, such as by heating, so that there is no gap therebetween. However, tape may form an eyelet 129 by not joining portions of tape at the location of fold 128.

Figure 12:
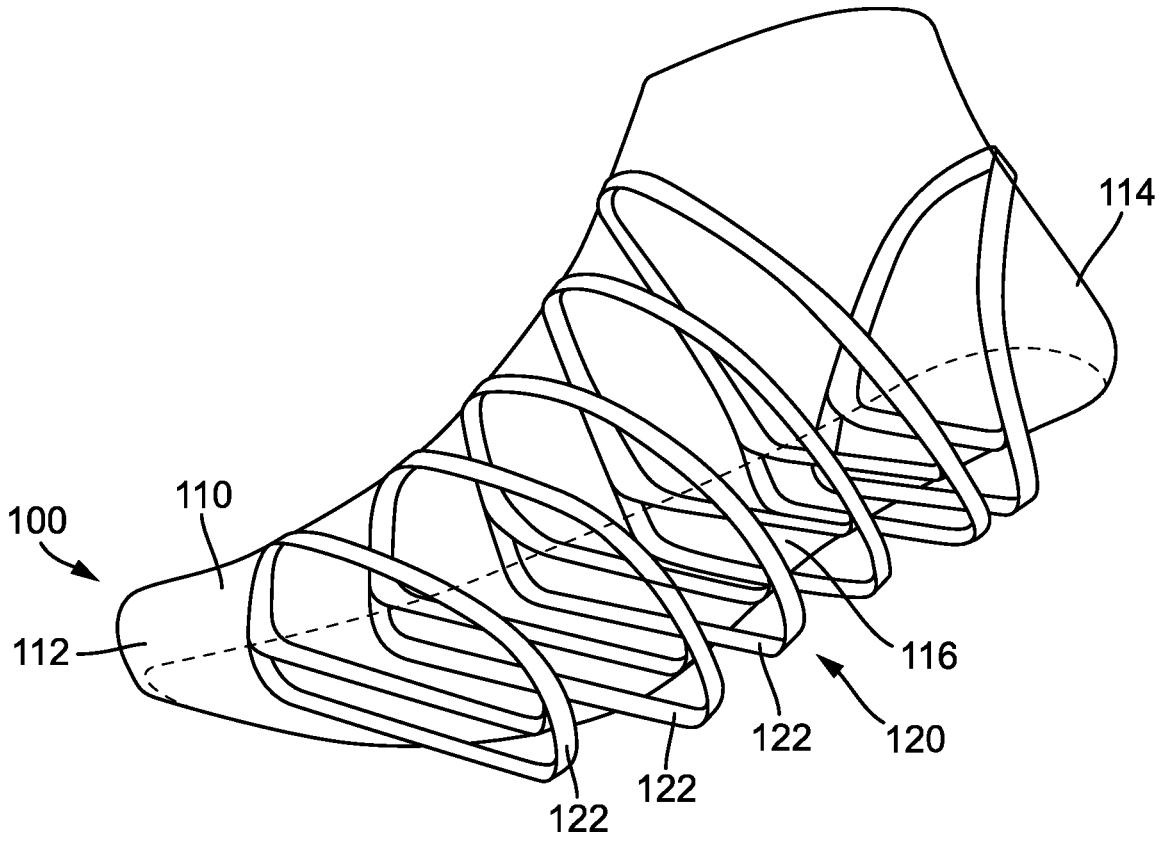
FIG. 12 shows a perspective view of elongated support structures arranged in a loop according to an embodiment.

In some embodiments, elongated support structures 122 may extend from a bottom portion or a sole of a footwear component 100 onto the upper 110. In some embodiments, elongated support structures 122 may be arranged so as to form a loop around a portion of footwear component 100, as shown for example in FIG. 12. In such embodiments, support structures 122 may extend in a transverse direction of an upper 110 (e.g., in a direction from a medial side to a lateral side). For example, a support structure 122 may be placed on a medial side of upper 110, extend onto a bottom portion of upper (or a sole or midsole attached thereto), extend from the bottom portion onto an opposing lateral side of upper 110, and extend across a top of upper so as to return to medial side of upper 110. Each support structure 122 may be spaced from one another. Support structures 122 may be arranged on one or more of the toe region 112, midfoot region 116, and heel region 114. In some embodiments, footwear component 100 may include a sole or midsole, and loops of support structure 122 may alternatively or additionally wrap around the sole or midsole attached to upper 110.

Figure 13:
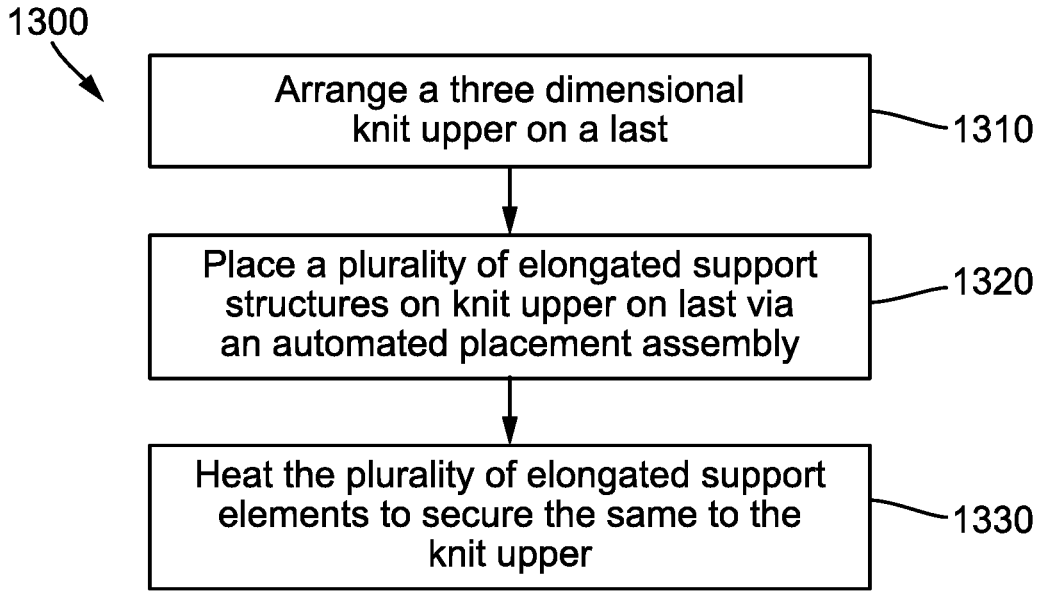
FIG. 13 shows a method of manufacturing a footwear component having elongated support structures according to an embodiment.

In an exemplary method of manufacturing a footwear component 1300, as shown in FIG. 13, an upper, such as a three-dimensional knit upper may be arranged on a last 1310. A plurality of elongated support structures may be placed on the knit upper arranged on the last by an automated placement assembly 1320. The automated placement assembly may place the elongated support structures one at a time, and may arrange each support structure in any of various directions and orientations. Further, automated placement assembly may place various types of support structures formed from various materials to provide the resulting footwear with the desired properties and characteristics. Once all elongated support structures are placed, the upper and elongated support structures may be heated so as to secure the elongated support structures to the upper 1330. In this way, the footwear component may be formed in a single process, and no separate process, such as a die cutting or molding process is needed to form support structures prior to securing the same to the knit upper.

Figure 14:
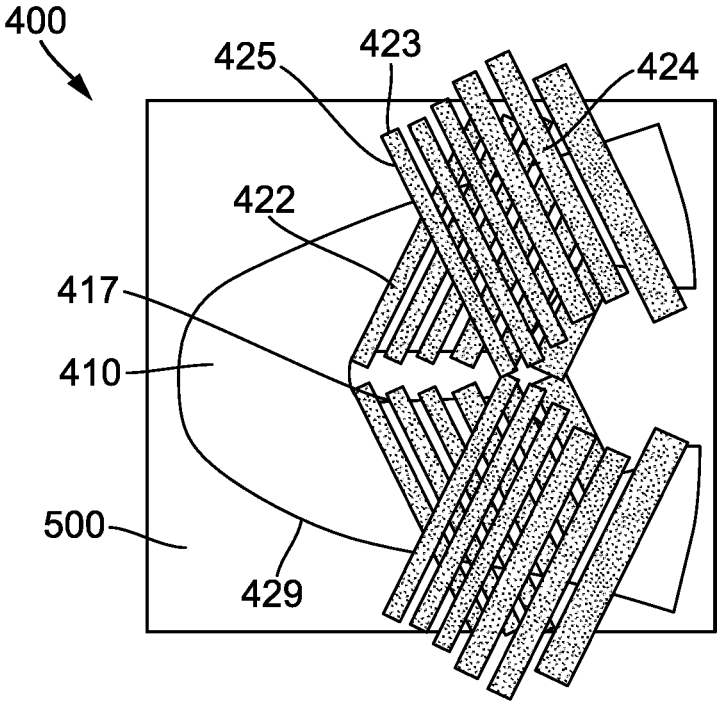
FIG. 14 shows a top-down view of an upper having unfinished elongated support structures placed thereon according to an embodiment.

In some embodiments, a footwear component 400 may include a two-dimensional upper 410, as shown for example in FIG. 14. Upper 410 may be arranged on a platform 500. Platform 500 may be generally planar so that two-dimensional upper 410 can be positioned flat on platform 500. Support structures 422, 424 may be placed on upper 410 by an automated placement assembly as described above with respect to footwear component 100, as shown for example in FIG. 1. Thus, automated placement assembly may place support structures on upper in any of various orientations and directions. Support structures may be formed from any of various materials and may be for example, tape or fibers, as discussed above with respect to footwear component 100. Platform 500 may be in a fixed position or may be movable so as to adjust a relative position of upper 410 and an automated placement assembly. Once placed on upper 410, support structures 422, 424 may be heated to secure the support structures 422, 424 to the upper 410, as discussed above with respect to footwear component 100.

Figure 15:
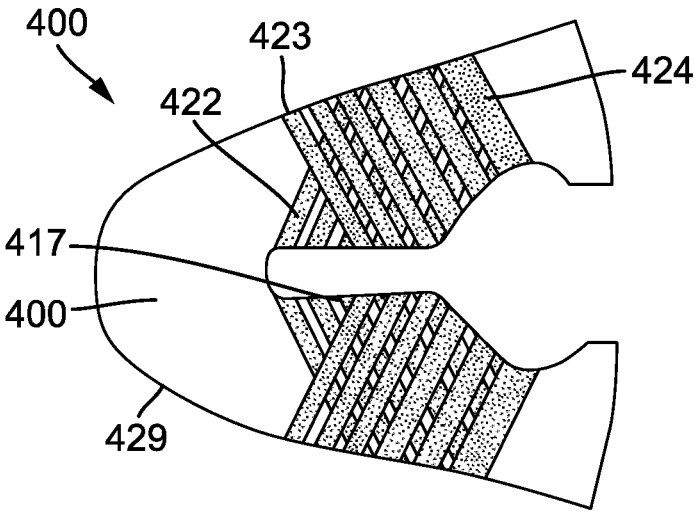
FIG. 15 shows a top-down view of the upper of FIG. 14 having finished elongated support structures according to an embodiment.

In some embodiments, elongated support structures 422 are placed onto upper 410 and an excess portion 425 of support structures 422 may extend beyond a perimeter edge 429 of upper 410, as shown in FIG. 14. For example, an excess portion 425 of an elongated support structure 422 may extend beyond perimeter edge 429 of upper 410 and onto platform 500 or may extend into a throat 417 of upper 410. In order to remove the excess portions 425 of the support structures 422, 424, excess portions 425 that extend beyond perimeter edge 429 may be cut or trimmed. Cutting may be performed by a cutting tool. In some embodiments, cutting tool may be incorporated in the automated placement assembly. In some embodiments, cutting may be performed manually, such as by an operator using a blade, knife, box cutter, scissors, or the like. For example, first support structures 422 may be placed on upper 410 such that an excess portion 425 extends beyond perimeter edge 429 of upper 410, as shown in FIG. 14. Second support structures 424 may be placed on upper 410 such that an excess portion 425 also extends beyond a perimeter edge 429 of upper 410. The excess portions 425 may be removed by cutting so that support structures 422, 424 are applied to upper 410 and have end portions 423 that terminate at perimeter edge 429 of upper 410, as shown in FIG. 15. In this way, footwear component 400 has a clean appearance with support structures 422, 424 secured to upper 410. In some embodiments, end portion 423 may be flush with perimeter edge 429 so that support structures 422, 424 extend along upper and terminate at perimeter edge 429.

Figure 16:
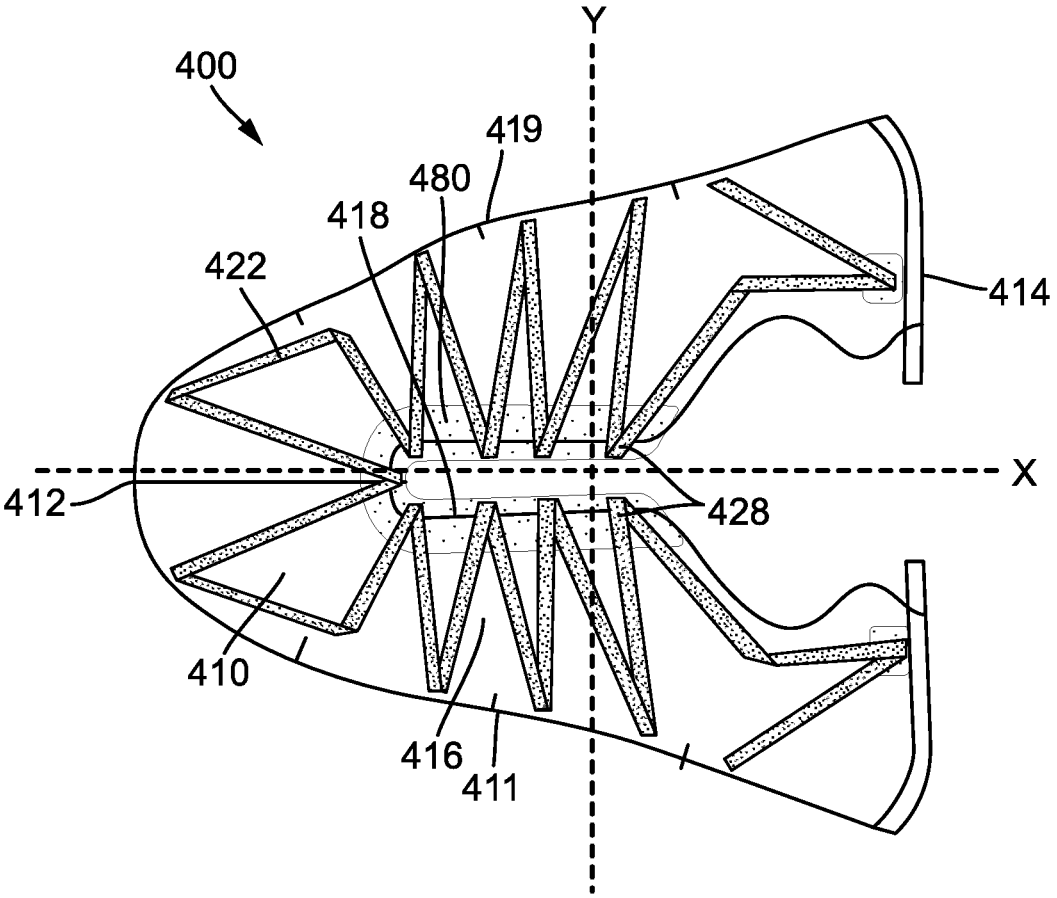
FIG. 16 shows a top-down view of an upper having elongated support structures according to an embodiment.

A two-dimensional upper 410 may include an arrangement of support structures 422 as shown for example in FIG. 16. In FIG. 16, two-dimensional upper 410 includes a toe region 412 and a heel region 414, and a medial side 411 opposite a lateral side 419. Upper 410 further includes a throat 418 extending from heel region 114 toward toe region 112. One or more elongated support structures 422 may be placed on upper 410 to provide support to various portions of upper 410 and/or to create a desired pattern.

In some embodiments, a single elongated support structure 422 may be arranged so as to extend in a variety of different directions and orientations to create a desired pattern. Alternatively, a plurality of support structures 422 may be placed on upper 410 to achieve the desired pattern. Support structures 422 may extend between medial side 411 and throat 418, and may extend between lateral side 419 and throat 418. Support structures 422 may be arranged in a zig-zag pattern. Support structures 422 may be arranged parallel to axis Y extending from medial side 411 to lateral side 419, or may be arranged at an angle thereto. Further, support structures 422 may be arranged along an axis X extending from heel region 414 to toe region 412, or may be arranged at an angle thereto.

Support structures 422 placed on upper 410 may be secured to upper 410 via application of heat to support structures 422. In some embodiments, support structures 422 in region 480 adjacent throat 418 of upper 410 may not be heated so that support structures 422 may form eyelets 428 adjacent throat 418, as discussed above with respect to FIG. 11.

Figure 17:
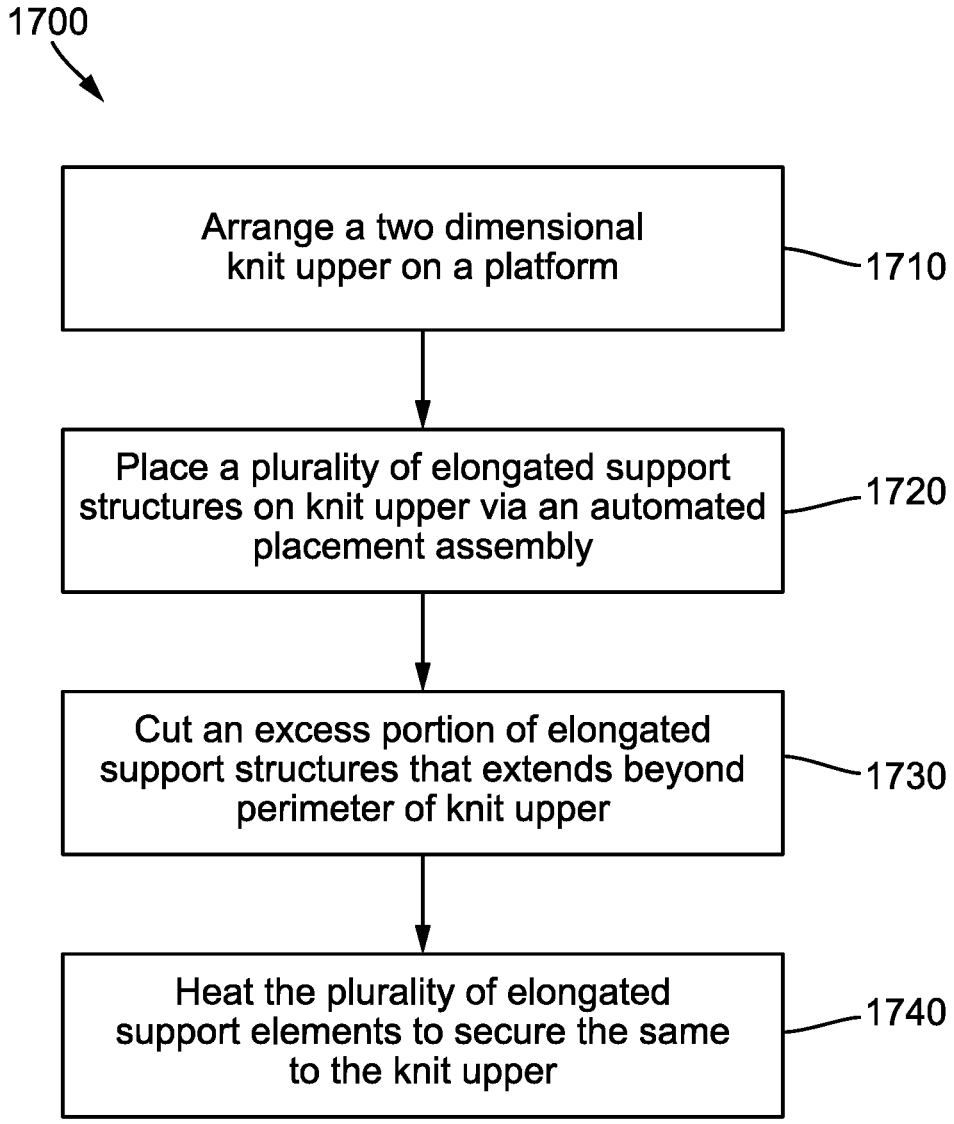
FIG. 17 shows a method of manufacturing a footwear component having elongated support structures according to an embodiment.

An exemplary method 1700 for manufacturing a footwear component having support structures is shown in FIG. 17. A two-dimensional upper, such as a knit upper, may be arranged on a platform 1710. Platform 1710 may be a flat or planar surface. A plurality of elongated support structures can be positioned on the upper via an automated placement assembly 1720. Automated placement assembly may place the elongated support structures on the upper in any of various directions and orientations to provide reinforcement or support to various portions of upper and/or to achieve a desired pattern or visual effect. As support structures may be placed in such a way that an excess portion of support structures extends beyond a perimeter edge of upper. The excess portion of the support structures that extend beyond the perimeter edge of the upper may be cut 1730 so that the support structures terminate at the perimeter edge of the upper. In order to secure the support structures to the upper, the plurality of support structures may be heated 1740. In some embodiments, heat may be applied after each support structure is placed, or alternatively, heat may be applied after all support structures are placed.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the following claims and their equivalents.

What is claimed is:

1. A method for manufacturing an article of footwear, comprising:

arranging a three-dimensional upper on a last;

placing a plurality of elongated support structures on the three-dimensional upper arranged on the last using an automated placement assembly, wherein the plurality of elongated support structures comprises a first support structure and a second support structure spatially separated from the first support structure, and wherein placing the plurality of elongated support structures comprises:

terminating an end portion of the first elongated support structure at a perimeter edge of the three-dimensional upper, placing a first free end portion of the second elongated support structure at a location spaced away from any perimeter edge of the three-dimensional upper and spaced away from a bottom of the upper, and placing a second free end portion of the second elongated support structure at a location spaced away from any perimeter edge of three-dimensional upper and spaced away from the bottom of the upper; and heating the plurality of elongated support structures to secure the plurality of elongated support structures to the upper.

2. The method of claim 1, wherein the plurality of elongated support structures comprises reinforcement tape.

3. The method of claim 1, wherein the plurality of elongated support structures comprises fibers.

4. The method of claim 1, further comprising placing a plurality of second elongated support structures on the upper using the automated placement assembly, such that the plurality of second elongated support structures at least partially overlaps the plurality of elongated support structures.

5. The method of claim 4, wherein the plurality of elongated support structures and the plurality of second elongated support structures form a lattice.

6. The method of claim 4, wherein one or more of the plurality of second elongated support structures are arranged at an angle of 5 to 85 degrees relative to one or more of the plurality of elongated support structures.

7. The method of claim 1, further comprising forming eyelets using the plurality of elongated support structures.

8. The method of claim 1, further comprising movably positioning the last relative to the automated placement assembly.

9. The method of claim 1, further comprising securing a sole to the upper, and wherein placing the plurality of elongated support structures comprises arranging one or more of the plurality of elongated support structures so as to extend from the sole onto the upper.

* * * * *